United States Patent [19]

Maynard, Jr.

[11] 4,267,945

[45] May 19, 1981

[54] LIQUID FUNNEL AND CONTAINER PIERCING BLADE COMBINATION

[76] Inventor: Walter P. Maynard, Jr., 3070 Presidential Dr., Suite 236, Atlanta, Ga. 30340

[21] Appl. No.: 63,857

[22] Filed: Aug. 6, 1979

[51] Int. Cl.[3] ..... B67B 7/28

[52] U.S. Cl. ..... 222/83.5; 141/327; 141/330; 222/479; 285/27

[58] Field of Search ..... 222/80, 81, 83, 83.5, 222/85, 86, 88, 479, 570, 527; 220/85 SP, 293, 298; 141/300, 330, 331, 337; 215/220, 221, 222, 332, 356, 357; 285/24, 27

[56] References Cited

U.S. PATENT DOCUMENTS

| | | | |
|---|---|---|---|
| D. 241,597 | 9/1976 | Confer et al. | 141/331 X |
| 712,094 | 10/1902 | Raymond | 215/357 |
| 1,427,545 | 8/1922 | Orr | 222/83.5 X |
| 1,612,383 | 12/1926 | Lepeshkin | 141/300 |
| 2,002,611 | 5/1935 | Nall | 141/330 |
| 2,038,775 | 4/1936 | Weber | 222/86 X |
| 3,637,113 | 1/1972 | Stehl | 222/86 |
| 3,782,574 | 1/1974 | Rumble | 215/221 X |
| 3,799,399 | 3/1974 | DiBattista | 222/83.5 |

*Primary Examiner*—David A. Scherbel
*Assistant Examiner*—Fred A. Silverberg
*Attorney, Agent, or Firm*—Newton, Hopkins & Ormsby

[57] ABSTRACT

A piercing and pouring device for metal or paper containers of motor oil or the like comprising a funnel with the tip of a container piercing blade vertically positioned on an element releasably secured within the funnel. The funnel has a cylindrical container receiving portion with a depending, tapering, pouring spout integrally connected thereto, the spout being flexible along a portion of its length. The piercing point of the blade engages the top of a container as it is telescopically positioned within the receiving portion of the device so that the liquid therein is dispensed through the spout.

5 Claims, 6 Drawing Figures

LIQUID FUNNEL AND CONTAINER PIERCING BLADE COMBINATION

BACKGROUND OF THE INVENTION

1. Field of the Invention

This invention relates to a liquid pouring device and, more particularly, to a liquid funnel and container piercing blade combination.

2. Description of the Prior Art

It is common to use funnel-type devices for pouring liquids, such as motor oil, into an automobile engine without spilling oil on the engine or on the hands of the user. Either the liquid container is first pierced and then placed in the pouring device or the device is provided with a container-piercing element integrally connected thereto.

Usually, those prior art funnels are constructed of metal with a short, rigid spout so that the user has to place his hands close to the crankshaft oil opening, thereby increasing the opportunity to dirty them. If the funnel does not include built-in means for piercing the liquid container, the chance of spills is increased since the container has to be opened in some manner externally of the funnel and then turned upside down into the funnel for pouring.

SUMMARY OF THE INVENTION

The above disadvantages are overcome by the present invention which combines a funnel constructed of plastic material with a piercing blade mounted on an assembly removably disposed within the funnel. The invention is adapted for cylindrical side wall liquid containers having at least one flat, closed end.

The funnel includes an upper, hollow, cylindrical body portion having an open top and which is dimensioned to telescopically receive the container. Two indented rings are circumferentially spaced on the body portion. The upper ring carries a container bearing surface on its interior side for guiding the container into piercing position within the funnel.

Disposed within the upper body portion below the first ring and above the second ring is a substantially circular element for carrying a container piercing blade so that its piercing point extends upwardly toward the open top of the funnel. The element includes a lip extending outwardly from the periphery of the element, the underside of the lip resting on the top of the second indentation.

Means is provided for releasably securing the piercing blade carrying element in a selected position within the body portion and includes protrusions which are spaced about the interior of the body portion and which are formed by inwardly directed indentations on the exterior of the body portion. The protrusions have a downwardly sloping top surface which terminate in flat bottoms which are disposed adjacent to and above the second ring. The width of the protrusions is complimentary to the width of the respective openings on the periphery of the blade-carrying element. At least one of the protrusions and its corresponding element opening are dimensioned differently than the remaining protrusions and respective openings, so that the blade carrying element is positioned within the body portion in only one position, with the bottom of the blade housing in registry with the top of a protrusion formed on the interior of the body portion, the protrusion serving to support the bottom of the blade carrying element as the blade pierces the container top. An open groove is formed in the top of the blade carrying element adjacent to one side of each of the openings.

The blade is of unitary metal construction and is divided longitudinally with upper sets of opposed teeth thereon. The teeth are embedded in the thermoplastic material of the blade housing to securely position the blade therein.

A dispensing spout depends from the bottom of the funnel and is flexible along a portion of its length so that it can be fixed in any desired pouring position. The spout includes an inwardly tapering bottom section which terminates in the pouring opening. A plurality of longitudinally extending air channels are spaced about the interior surface of the bottom section to aid in smoothly dispensing the fluid from the funnel.

In operation, the upper body portion is laterally squeezed by the user into essentially an elliptical shape so that the circular blade-carrying element may be inserted thereunto past the first indented ring. The pressure on the body portion is released so that it returns to its normal shape and the blade-carrying element is rotated so that the protrusions are in registry with the respective openings. The element is lowered over the protrusions and rotated slightly so that the flat bottoms of the lugs rest on the open-topped grooves on the element and the lip on the element is in contact with the interior surface of the second ring.

The spout is moved to the desired pouring position by means of the flexible portion and the lower portion of the spout is inserted into, for instance, the motor oil opening on an engine. A liquid container is inserted through the top of the body portion until the top of the container comes into contact with the piercing point of the blade. Further downward pressure on the container will cause the blade to pierce the top of the container and the contents to flow through the blade and into the dispensing spout.

The blade carrying element may be readily removed from the upper body portion by counter-rotating the element so that the grooves are no longer in locking engagement with the bottom of the protrusions and the protrusions are in registry with the openings. The upper body portion is squeezed by the user and the element is withdrawn from the funnel. The interior of the funnel, as well as the piercing blade, can then be cleaned of residue.

It is, therefore, a primary object of the present invention to provide a device which facilitates the opening of a liquid container and the dispensing of the contents therefrom.

Another object of the present invention is to provide a device which easily perforates the top of a liquid container and to provide for the selective fixation of the pouring spout in any desired pouring position.

Another object of the present invention is to provide for a container piercing blade which is detachably secured within a pouring funnel.

A still further object of the present invention is to provide a liquid funnel and container piercing blade combination.

DESCRIPTION OF THE ILLUSTRATIVE EMBODIMENT

Figure 1:
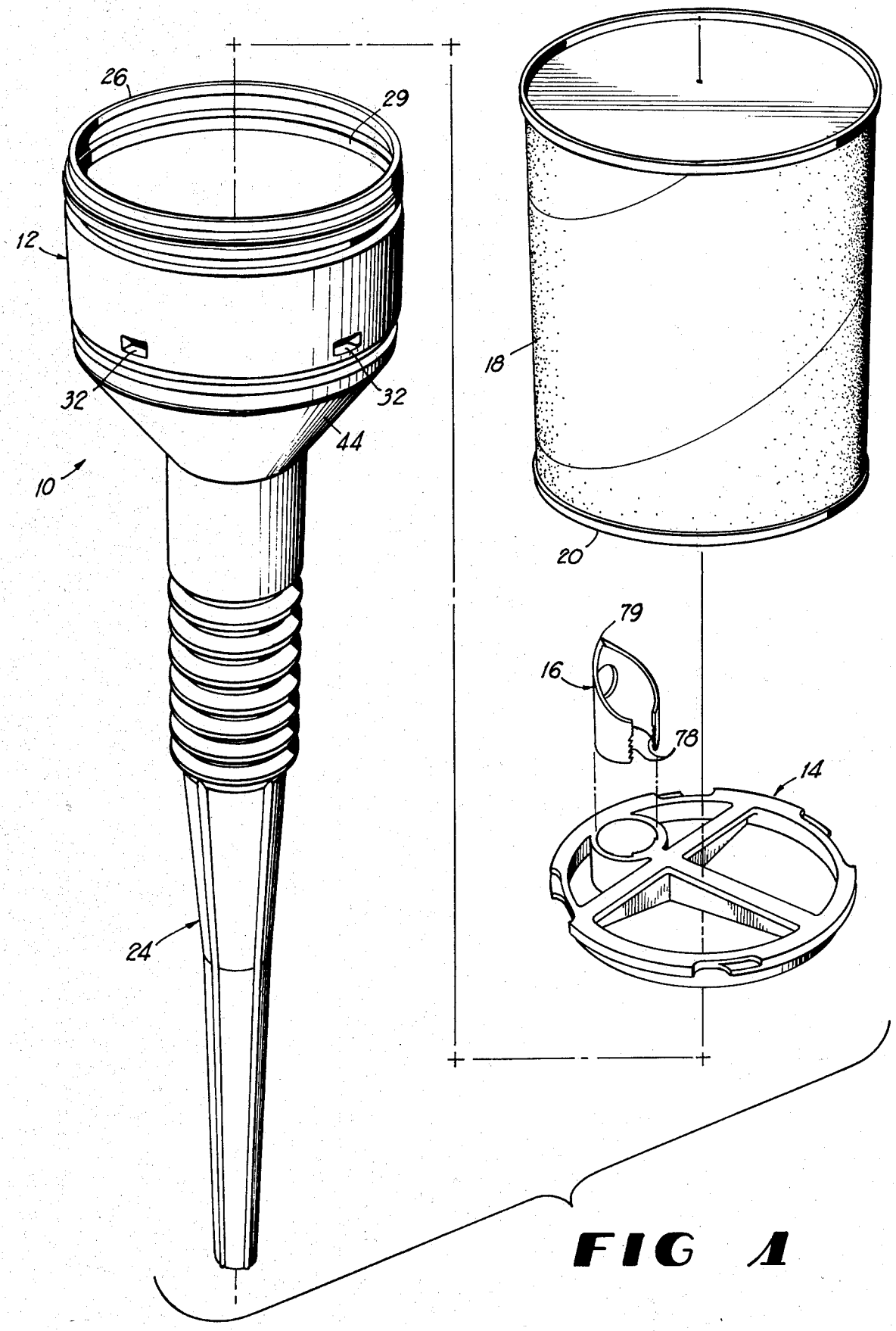
FIG. 1 is an exploded perspective view of the invention in relation to a container of the type with which the invention is used.

Referring to FIG. 1 of the drawings, numeral 10 denotes generally the present invention and includes a funnel 12, a container piercing blade-carrying element 14 and a container piercing blade 16. The invention 10 is utilized with a cylindrical container 18 for motor oil or the like which may be formed of metal or paper, in each case including a flat cover 20.

The funnel 12 is preferably formed of medium or high density polyethylene or polypropylene plastic and includes an upper, hollow, cylindrical-shaped body portion 22 and a pouring spout 24 depending therefrom. The upper body portion 22 is dimensioned to telescopically receive through the open top 26 the container 18 with cover 20 in the downward position as shown in FIG. 1. An upper indented ring 28 circumferentially extends about the upper body portion 22 adjacent the open top 26 and carries a container-bearing surface 29 on its inner side. A second indented ring 30 is on body portion 22 below the first ring 28 and has an interior surface 31. The rings 28, 30 provide structural stability to the upper body portion 22.

Figure 2A:
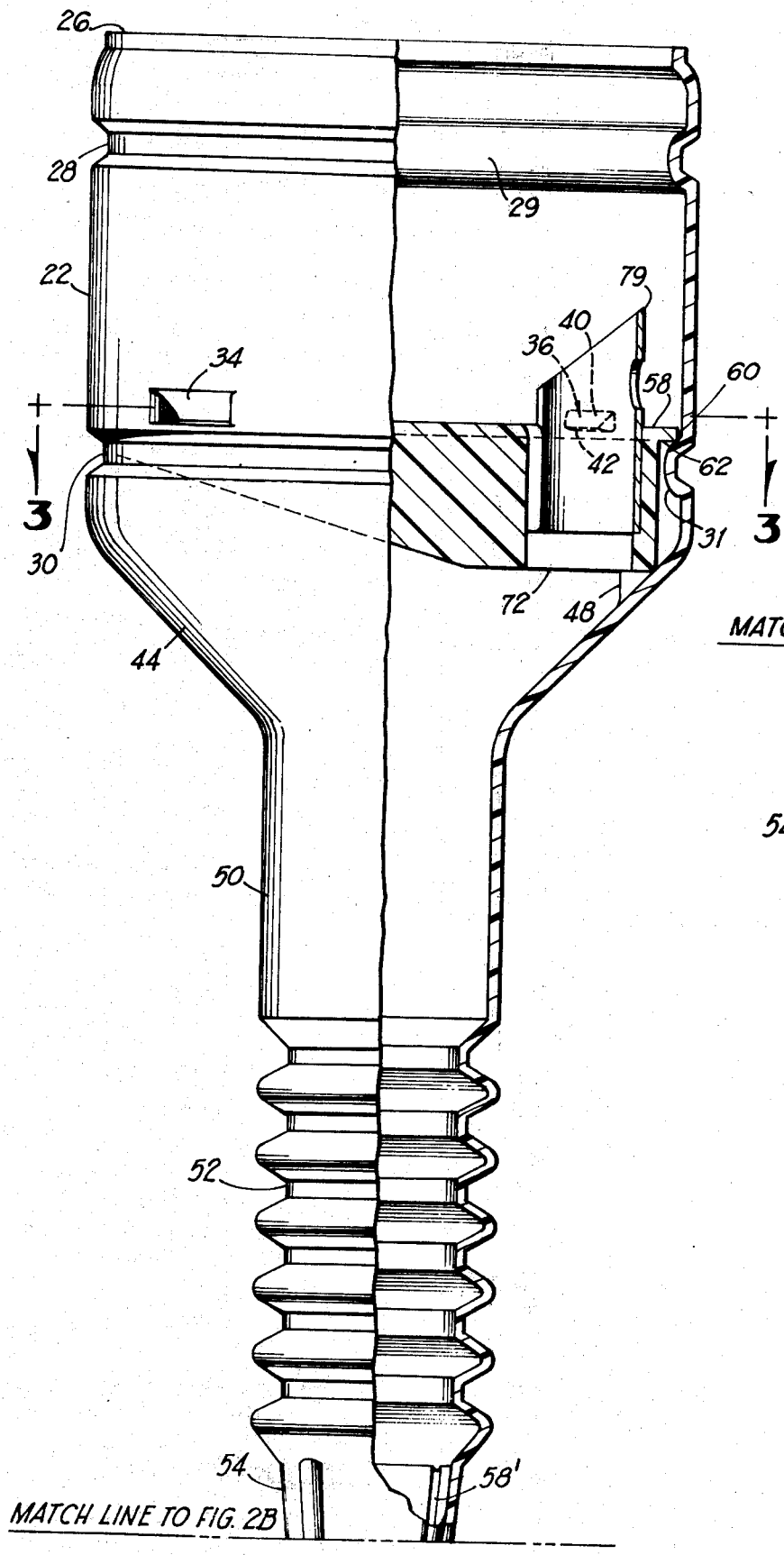
FIG. 2A is a side elevational view of a portion of the invention in its assembled configuration with parts broken away for clarity.
Figure 2B:
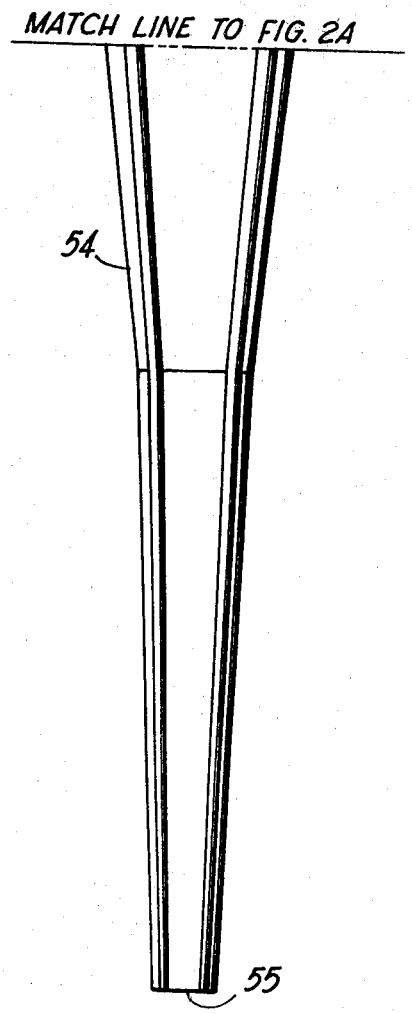
FIG. 2B is a continuation of the side elevational view of the present invention.
Figure 3:
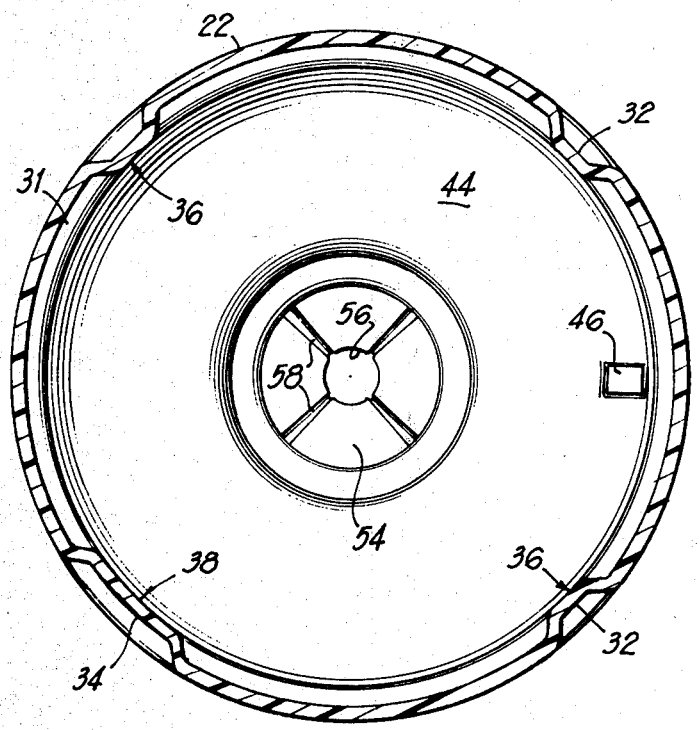
FIG. 3 is a top plan view of the funnel taken along line 3—3 in FIG. 2 with the blade carrying element removed for clarity.

Means are provided on the funnel 12 for releasably securing the blade-carrying element 14 within the body portion 22 and preferably comprise indentations 32, 34 which extend about the outer circumference of the upper body portion 22 above the second ring 30. As shown in FIG. 3, the three indentations 32 are equally dimensioned and carry on their interior surfaces protrusions 36 with indentation 34 being wider than indentations 32 and having a respective protrusion 38. As seen in phantom lines in FIG. 2A, the protrusions 36 carry downwardly sloping surfaces 40 which terminate in inwardly directed, horizontal bottoms 42. The protrusion 38 is similarly shaped.

Below the second ring 30, the upper body portion 22 terminates in an inwardly tapering portion 44. As seen in FIGS. 2A and 3, an indentation (not shown) is formed on the exterior of portion 44 which carries on its interior surface a flat, horzontal top ledge 46, the leading edge of which terminates in depending wall 48.

The spout 24 includes a cylindrical inner portion 50 which is in flow communication with the tapering portion 44, the inner portion 50 having a smaller diameter than upper body portion 22. An intermediate spout portion 52 is accordion-pleated along its length and communicates the inner portion 50 with the outer end portion 54 of the spout 24. The outer end portion 54 terminates in bottom opening 55 and is inwardly tapering along its length. As seen in FIGS. 2A and 3, four equally spaced, longitudinally extending air channels 58' are formed along the interior wall of outer end portion 54.

Figure 4:
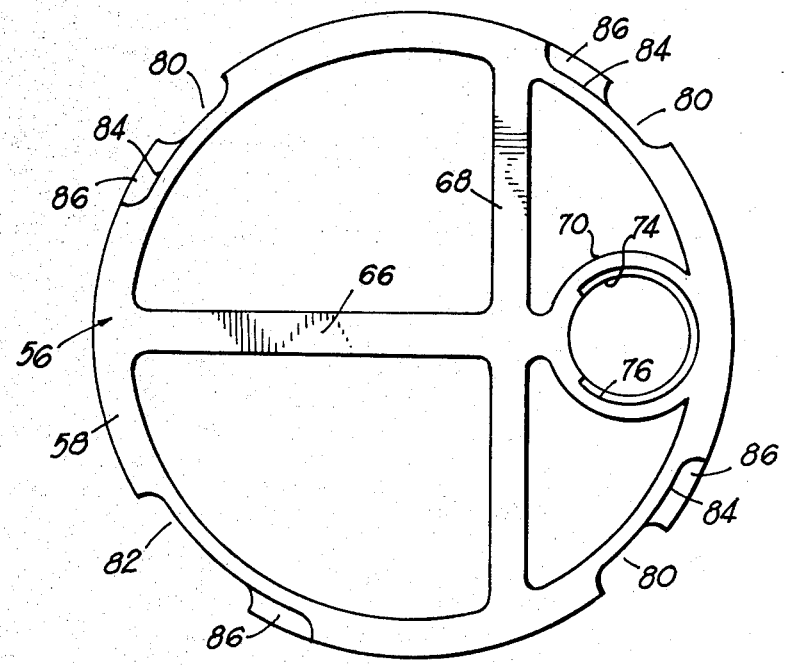
FIG. 4 is a top plan view of the blade carrying element of the present invention.
Figure 5:
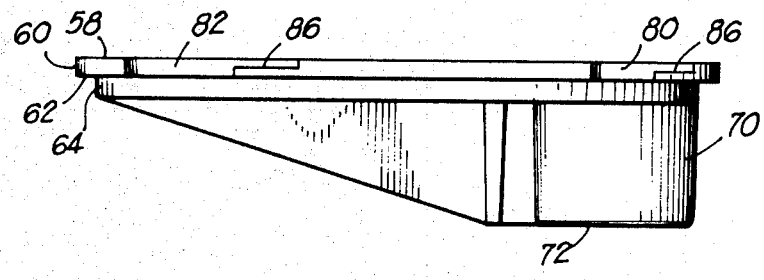
FIG. 5 is a side elevational view of the blade carrying element of FIG. 4.

Referring to FIGS. 4 and 5, the blade-carrying element 14 is preferably formed of rigid plastic and is substantially circular in shape, having an outer ring portion 56 with flat, top surface 58 and depending outer side wall 60 which terminates in horizontal, inwardly directed underside 62. The rear of underside 62 ends in depending, circular wall face 64. As seen in FIG. 2A, the diameter of outer ring portion 56 is such that side wall 60 is adjacent the interior surface of the upper body portion 22 when the element 14 is releasably secured within upper body portion 22 in its operative position. The wall face 64 is then in opposed relationship to the surface 31 of the second indented ring 30.

The element 14 further includes a T-shaped brad integrally formed within the interior of the outer ring 56 and including diametrically extending rib 66 and cross-rib 68. As seen in FIGS. 4 and 5, a circular blade housing 70 is integrally connected to the interior of the outer ring 56 and to the brace at the juncture of the rib 66 and cross-rib 68 and vertically projects below the outer ring 56, terminating in flat bottom surface 72. The top of housing 70 is flat and, as seen most clearly in FIG. 5, is co-planar with top surface 58, as are the uppermost surfaces of rib 66 and cross-rib 68.

Within the bore 74 of the blade housing 70 is a partial counter-bore 76 which receives the blade 16. As seen in FIG. 2A, the counter-bore 76 vertically extends through a portion of bore 74. The blade 16 is directed longitudinally and the set of teeth 78 on the opposing edges of the blade 16 are embedded in the portion of the bore 74 which is not removed by counter-bore 76, as shown in FIG. 1. The housing 70 is heated and softened during the manufacturing process and the blade 16 is inserted into the counter-bore 76 to the depth as shown in FIG. 2A; as the plastic material cools, it flows over teeth 78 to lock the blade 16 securely within the housing 70. The blade includes a piercing point 79.

Referring to FIG. 4, vertical openings 80, 82 are spaced about the outer periphery of ring 56 with openings 80 being equally dimensioned so as to allow protrusions 36 to pass therethrough and with opening 82 being of sufficient size to allow protrusion 38 to pass therethrough. Grooves 84 are formed in the outer periphery top surface 58 to the right of each opening 80, 82, as viewed in FIG. 4, each groove 84 having a bottom surface 86. Referring to FIG. 2A, the bottoms 42 of protrusions 36, 38 are so disposed above surface 31 of second ring 30 a distance equal to the height of ring 56.

In the operation of the invention 10, the blade-carrying element 14 is inserted into funnel 12 by grasping the funnel 12 in one hand and squeezing upper body portion 22 so that the top opening 26 momentarily assumes an essentially elliptical shape. The element 14 is tilted and is lowered through open top 26 into the cavity of the upper body portion 22 past the surface 29, at which point the squeezing pressure is removed from upper body portion 22, allowing it to return to its normal cylindrical configuration.

The element 14 is then rotated so that the openings 80 on element 14 are in registry with protrusions 36 and opening 82 is in vertical alignment with protrusion 38. The element 14 is then lowered over the sloping surfaces of the protrusions 36, 38 until the underside 62 of the outer ring 56 of element 14 engages the surface 31 of the second indented ring 30 and the bottom surface 72 of blade housing 70 rests on the top ledge 46. The element 14 is rotated clockwise so that the bottoms 42 of protrusions 36, 38 engage the bottom surface 86 of the grooves 84. The element 14 is, thus, releasably secured within funnel 14 in only one operative position by means of the different sized protrusions 36, 38 and respective openings 80, 82 so that the ledge 46 supports the housing 70, as shown in FIG. 2A.

The container 18 is inserted into the upper body portion 22 through open top 26, surface 29 being in sliding engagement with the side of the container 18 and acting to position the container 18 in a vertical attitude within the funnel 12. Further downward pressure of the container 18 causes point 79 to pierce the cover 20 and allow the contents of container 18 to flow through the blade 16 and pouring spout 24, the intermediate spout portion 52 having been bent to the desired pouring angle. The top ledge 46 aids in supporting the blade housing 70 when the pressure necessary to pierce the container cover 20 is applied to the container 18. The height of the upper body portion 22 is such that some portion of the bottom of the container 18 extends above open top 26.

When the contents have been dispensed from the container 18, the portion of the container 18 that extends above top 26 is grasped and pulled upwardly whereby the surface 58 of ring 56 is engaging the interior surface 29 of the first indented ring 28 blocks further upward movement of the container 18 and blade carrying element 14. The container 18 is jerked upwardly to disengage the pierced cover 20 from the blade 16. The element 14 may be removed from the upper body portion 22 by reversing the steps as set forth above, or it may be repositioned within the upper body 22. Once removed from the funnel 12, the element 14 and blade 16 as well as the interior of the funnel 12 can be cleaned of residue.

What I claim is:

1. A piercing and pouring device for a cylindrical side wall container having dispensing material therein and having a cover, comprising: a hollow body portion having an open top, a bottom and an interior wall surface and being dimensioned to telescopically receive therein said container; a pouring spout depending from said bottom and terminating in a pouring opening, said spout being in flow communication with said body portion; a container piercing blade carrying element which is circular in shape; means for releasably securing said blade carrying element within said body portion; and a piercing blade on said blade carrying element and having a piercing point upwardly extending from said carrying element toward said open top, said securing means including a protrusion on said interior wall surface, said protrusion having a flat bottom surface, said blade carrying element having an opening on its other periphery, said opening dimensioned to have said protrusion pass therethrough, and said blade carrying element having a groove on its outer periphery in communication with said opening, said blade carrying element being inserted within the interior of said hollow body portion with said opening in registry with said protrusion, said blade carrying element being lowered beneath said protrusion and rotated so as to have said flat bottom surface engage said groove and wherein said securing means includes said blade carrying element having a plurality of said openings and respective grooves and said interior wall surface carrying a plurality of said protrusions, each dimensioned to cooperate with a respective one of said openings, the bottom surfaces of said protrusions being co-planar, wherein one of said openings and one of said protrusions are dimensioned so as to cooperate only with each other so as to secure said blade carrying element in a selected position within said body portion and wherein a horizontal ledge projects outwardly from said interior wall surface so as to engage the bottom of said blade carrying element when it is in said selected position, said body portion further including a pair of spaced upper and lower indented rings circumferentially extending about its exterior surface for adding structural stability to said body portion, each of said indented rings having an interior annular surface which projects inwardly from said interior wall surface, said interior annular surface of said lower ring being disposed between said bottom surfaces of said protrusions and said horizontal ledge whereby said interior annular surface of said lower indented ring engages the underside of said blade carrying element when said blade carrying element is in said selected position.

2. A device as claimed in claim 1 within said pouring spout has an outer end portion which terminates in said pouring opening, an inner portion in flow communication with said bottom of said body portion and an intermediate portion interconnecting said outer end portion and said inner end portion.

3. A device as claimed in claim 2 wherein said outer end portion tapers downwardly.

4. A device as claimed in claim 2 wherein said intermediate portion is flexible along its length.

5. A device as claimed in claim 1 further including a blade housing vertically disposed on said blade carrying element and terminating in a bottom end, said piercing blade being telescopically received into said blade housing.

* * * * *